US007467616B2

(12) United States Patent
Kees et al.

(10) Patent No.: US 7,467,616 B2
(45) Date of Patent: Dec. 23, 2008

(54) INTERNAL COMBUSTION ENGINE

(75) Inventors: Don Andreas Josephine Kees, Billericay (GB); Stephan Daren Carroll, Wadhurst (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/839,824

(22) Filed: Aug. 16, 2007

(65) Prior Publication Data

US 2008/0060599 A1 Mar. 13, 2008

(30) Foreign Application Priority Data

Sep. 8, 2006 (GB) ..... 0617699.4

(51) Int. Cl.
*F02P 13/00* (2006.01)
*F02P 15/08* (2006.01)

(52) U.S. Cl. ..... 123/310; 123/151; 123/638

(58) Field of Classification Search ..... 123/151, 123/310, 638, 640
See application file for complete search history.

(56) References Cited

FOREIGN PATENT DOCUMENTS

| | | |
|---|---|---|
| EP | 0898058 | 2/1999 |
| GB | 1560832 | 2/1980 |
| JP | 8-35473 | 2/1996 |

*Primary Examiner*—T. M Argenbright
(74) *Attorney, Agent, or Firm*—Donald J. Lewis

(57) ABSTRACT

An internal combustion engine 10 has a cylinder head 11 slideably supporting one or more poppet valves 30. At least a portion of one of the poppet valves 30 in each combustion chamber of the engine 10 forms in combination with one or more secondary electrodes 35, 133, 233, 333, 433 a number of electrode pairs between each of which an electrical discharge is selectively caused to flow so as to initiate combustion in the respective combustion chamber. The electrode pairs may be formed at differing locations within each combustion chamber so as to improve combustion efficiency.

19 Claims, 8 Drawing Sheets

INTERNAL COMBUSTION ENGINE

FIELD

This description relates to internal combustion engines, and in particular to an engine which uses an electrical discharge or spark to initiate combustion.

BACKGROUND AND SUMMARY

It is well known to provide a spark plug having first and second electrodes to initiate combustion in a cylinder of an engine by causing an electrical discharge or spark to pass from the first to the second electrode.

It is a problem with such an arrangement that the spark plug takes up space in the cylinder head thereby limiting the size and positioning of the valves used to control the flow of gas into and out of the combustion chamber.

In order to overcome this problem, it has been proposed in European Patent Application 0898058 to combine a spark plug with one of the poppet valves controlling the flow of gas into a combustion chamber of the engine. Although this arrangement eliminates the disadvantage of a conventional spark plug ignited engine by enabling the poppet valves of the engine to be of a larger size and be positioned in a less limited manner, it has several disadvantages.

Firstly, the point of ignition is, as with a conventional spark plug ignited engine, located at a single point in the combustion chamber and so complex inlet and combustion chamber design is required in order to ensure that the mixture to be ignited is positioned at the position where the spark will be generated at the precise time the spark is produced. Secondly, because only a single spark is produced, the time taken for the flame front to propagate throughout the combustion chamber is relatively lengthy and so sufficient time has to be allowed for the combustion process to occur to a satisfactory degree while the piston of the engine is still within an a small range of crank rotation representing an optimum position after top dead center where combustion will produce the maximum torque. This means that the timing of the spark has to occur sufficiently before top dead center for combustion to be virtually complete while the piston is still within the optimum range after top dead center. The position the spark occurs before top dead center is known as the ignition advance angle of the engine and in general terms this ignition advance angle must be increased as the speed of the engine is increased due to the reduction in time available for combustion to occur. However, it is known that the use of large ignition advance angles tend to increase the susceptibility of an engine to knock and this is often a limitation to the maximum running speed of an engine.

In addition, the longer the period taken for combustion to occur the longer the time available for heat to transfer into the engine thereby reducing the thermal efficiency of the engine.

It is an object of this description to provide an improved internal combustion engine.

According to a first aspect of the description, there is provided an internal combustion engine having a cylinder block defining at least one cylinder, a piston slideably supported in each cylinder, a cylinder head defining in combination with each cylinder and piston a respective combustion chamber, each combustion chamber having at least two poppet valves to selectively allow gas to flow into and out of the respective combustion chamber, each poppet valve comprising a valve stem to slideably support the poppet valve in the cylinder head of the engine and a valve head to selectively open and close a gas flow path through a port formed in the cylinder head, at least one of the poppet valves has a portion forming a primary electrode cooperating in use with at least one secondary electrode not formed as part of the poppet valve to produce a number of electrode pairs wherein an electrical discharge is selectively caused to flow during operation of the engine between each of the electrode pairs so as to initiate combustion in the respective combustion chamber of the engine.

There may be several secondary electrodes each forming in combination with the primary electrode a respective one of the number of electrode pairs.

The primary electrode may have a number of discharge tips each forming in combination with the at least one secondary electrode a number of electrode pairs. That is to say, there may be one secondary electrode and several discharge tips.

Each discharge tip may form in combination with a respective secondary electrode one of the number of electrode pairs.

The at least one secondary electrode may be formed as an integral part of the cylinder head located adjacent the primary electrode.

Each secondary electrode may be an integrally formed projection.

Alternatively, the at least one secondary electrode may be fastened to the cylinder head so as to provide an electrical connection therebetween at a position adjacent the primary electrode.

As yet a further alternative, the at least one secondary electrode may be formed on a fuel injector nozzle located within the combustion chamber of the engine.

Each combustion chamber may have two or more poppet valves each having a primary electrode forming in combination with at least one secondary electrode a number of electrode pairs.

All of the poppet valves of each cylinder may have an electrode forming part of at least one electrode pair.

The ignition timing of each primary electrode may be independently controlled.

The ignition timing of each primary electrode may be independently controlled based upon the operating conditions of the engine so as to improve combustion in the respective combustion chamber.

Each poppet valve may be made from an electrically conductive material and may have a head portion forming the primary electrode and the poppet valve may be slideably mounted in the cylinder head so as to be electrically insulated therefrom.

Alternatively, each poppet valve may be made from an electrically insulating material and may have an electrically conductive core portion forming the primary electrode.

As yet another alternative, each poppet valve may be a hollow electrically conductive component defining an internal cavity used to house an internal member made from an insulating material, the internal member having an electrically conductive core portion forming the primary electrode.

According to a second aspect of the description, there is provided a poppet valve for use in an internal combustion engine in accordance with said first aspect of the description.

BRIEF DESCRIPTION OF THE DRAWINGS

The description will now be described by way of example with reference to the accompanying drawing of which:—

DESCRIPTION

Figure 1:
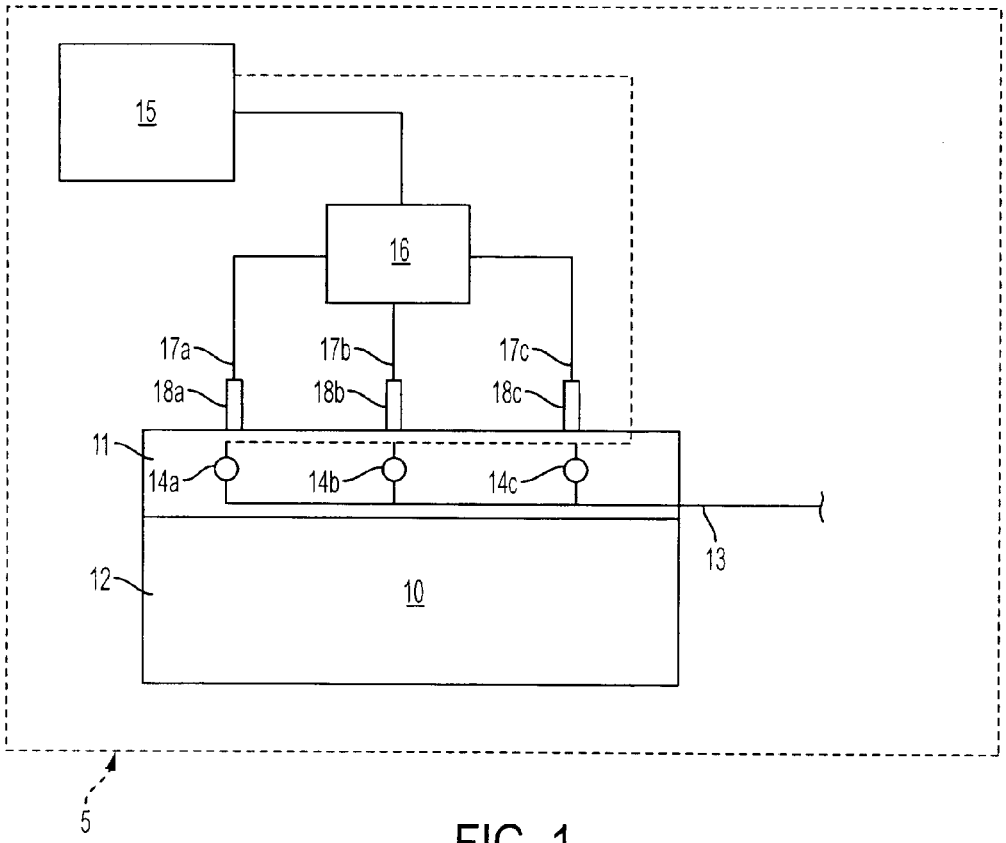
FIG. 1 is an outline drawing of a motor vehicle having an engine in accordance with this description.

With particular reference to FIG. 1, there is shown a motor vehicle 5 having an internal combustion engine configured as an inline three cylinder spark ignited engine 10.

The engine 10 comprises a cylinder head 11 and a cylinder block 12. The cylinder block 12 defines three cylinders (not shown) in each of which is slideably supported a piston (not shown). The cylinder head 11 and the cylinders form in combination with the pistons three combustion chambers (not shown).

Each of the combustion chambers is arranged to receive a supply of fuel via a respective fuel injector 14*a*, 14*b*, 14*c* fed with fuel via a supply line 13 from a reservoir (not shown). In this case the fuel injectors 14*a*, 14*b*, 14*c* inject fuel directly into the combustion chambers but it will be appreciated that they could alternatively inject the fuel by port injection. The fuel injectors 14*a*, 14*b*, 14*c* are controlled by an electronic control unit 15 which in this case is also used to control the ignition of the engine 10.

Combustion of the mixture in each combustion chamber is initiated by the discharge of an electrical current between primary and secondary electrodes. The primary electrodes are connected via respective tension connectors 18*a*, 18*b*,18*c* and tension leads 17*a*, 17*b*, 17*c* to a source of voltage electricity in the form of a tension generator 16 controlled by the electronic control unit 15. The secondary electrodes are connected to an earth point on the motor vehicle 5.

The electronic control unit 15 is operable to control the flow of fuel into each of the combustion chambers and the timing or phasing of the electrical discharge to each cylinder so as to produce efficient combustion within the engine 10.

Figure 2A:
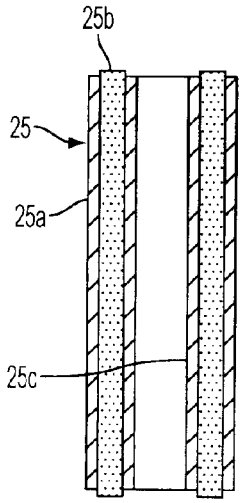
FIG. 2*a* is a cross-section through an alternative form of bushing used to slidingly support the poppet valve shown in FIG. 2.
Figure 2:
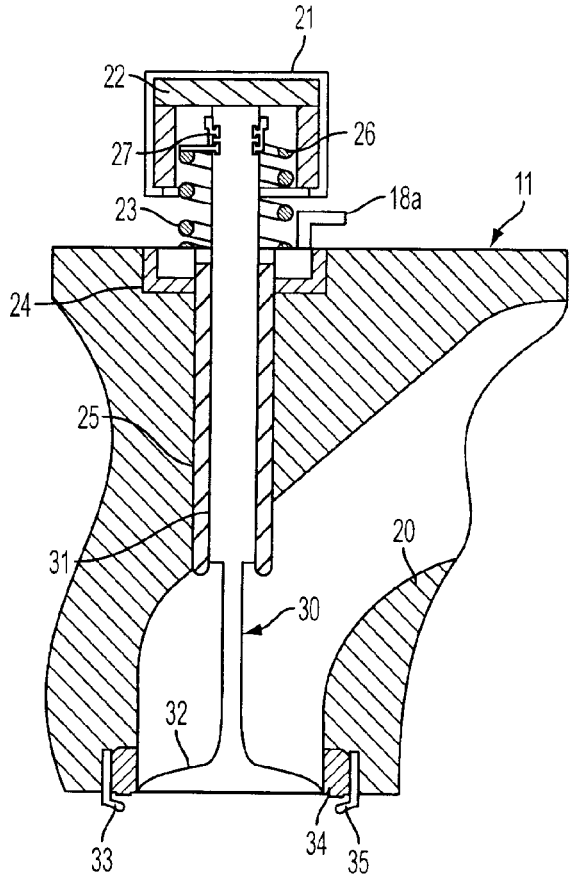
FIG. 2 is a cross-section through part of a cylinder head of the engine shown in FIG. 1 showing a combustion initiator in the form of a poppet valve according to the description.
Figure 3:
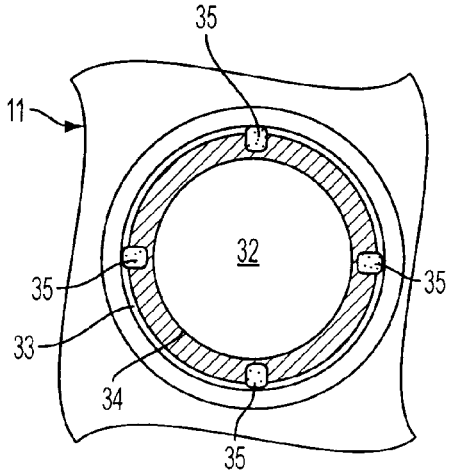
FIG. 3 is an end view of the poppet valve shown in FIG. 2.

With particular reference to FIGS. 2 and 3, there is shown part of the cylinder head 11 in the region of an inlet port 20 of one of the combustion chambers of the engine 10. The cylinder head 11 is in this case made from an electrically conductive material such as aluminum or cast iron.

A poppet valve 30 is provided to selectively open and close a gas flow path through the inlet port 20. The poppet valve 30 comprises a valve stem 31 to slideably support the poppet valve 30 in the cylinder head 11 of the engine and a valve head 32 to selectively open and close a gas flow path through the inlet port 20.

The valve stem 31 is slidingly engaged with a sleeve 25 made from an electrical insulating material such as a ceramic material. In FIG. 2*a* an alternative form of sleeve is shown in which a tube of insulating material 25*b* is interposed between inner and outer tubes 25*c* and 25*a* made from metal. Preferably, the inner tube 25*c* is made from a bearing metal. This sleeve 25 has the advantage that the tribology between a metal valve and a metal bushing is well understood whereas the tribology of a metal/ceramic interface is less well known. Preferably the insulating tube 25*b* is longer than the inner and outer tubes 25*c* and 25*a* so as to reduce the risk of electrical arcing between the inner and outer tubes 25*c* and 25*a*.

The valve head 32 is arranged to selectively abut against a valve seat 34 made from an electrical insulating material such as a ceramic material.

The valve seat 34 is used to fasten a secondary electrode in the form of an electrode ring 33 to the cylinder head 11. The electrode ring 33 has four inwardly directed projections 35 forming four electrodes and is electrically connected to the cylinder head 11 via direct contact therewith.

An upper end of the valve stem 31 is adapted to allow the valve 30 to be reciprocally moved between open and closed positions by means of a valve actuation means (not shown). The type of valve actuation means can be of any known type. In this case the valve 30 is moved by means of a cam operated rocker arm (not shown) which acts against a tappet 21 resting on an upper end of the valve stem 31. The tappet 21 is electrically insulated from the valve stem by means of an insulating cap 22 made from a ceramic material.

A valve spring 23 is provided to bias the valve 30 towards its closed position. The valve spring 23 acts between a washer 26 held onto the valve stem 31 by means of a retainer 27 and an abutment surface formed as part of the tension connector 18*a*. It will be appreciated that the valve spring 23, the washer 26 and the retainer 27 are all made from electrically conductive materials.

The tension connector 18*a* is electrically insulated from the cylinder head 11 by means of an insulating cup 24.

The poppet valve 30 is made from an electrically conductive material such as metal. One of the major advantages with this embodiment of the description is that a conventional inlet valve made from a well known material is used.

It will be appreciated that, although the description is being described with reference to a poppet valve used as an inlet valve, the poppet valve could be an exhaust valve and that the description is not limited to the use of an inlet valve as an ignition initiator.

In use the electrical control unit 15 is operable to command the tension generator 16 to supply a voltage via the tension lead 17*a* to the tension connector 18*a* when combustion is required in the respective combustion chamber with which the valve 30 cooperates.

The voltage flows through the valve spring 23 to the valve stem 31 and along the valve stem 31 to the valve head 32. The potential difference between the valve head 32 and the secondary electrode 33 which is grounded via the cylinder head 11 is such that electrical discharges or sparks occur between the edge of the valve head 32 and the electrodes 35 on the secondary electrode ring 33. Although not used in the example shown, the outer edge of the valve 30 may be coated with a tungsten material or may be made from a tungsten material.

Therefore, four electrode pairs are formed between the valve 30 which constitutes a primary electrode and the electrodes 35 on the secondary electrode ring 33.

This has the advantage that the area in which combustion can first occur is potentially larger than is the case with a conventional spark plug and in addition a relatively large kernel of initial combustion is produced which can then readily propagate within the combustion chamber. In addition as there are four potential spark gaps the probability of a no spark situation is decreased.

Although only one poppet valve 30 is shown in FIG. 2, it will be appreciated that each combustion chamber will have several poppet valves and that more than one of these can be used to initiate combustion.

Figure 4A:
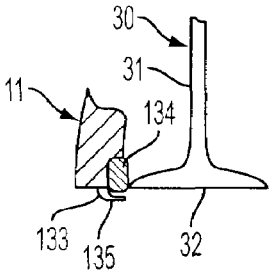
FIG. 4*a* is a scrap cross-section showing an alternative secondary electrode arrangement.
Figure 4B:
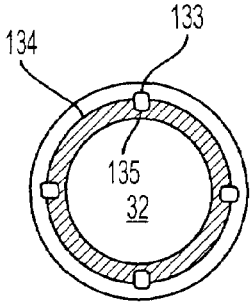
FIG. 4*b* is an end view of the poppet valve shown in FIG. 4*a;*

With reference to FIGS. 4*a* and 4*b*, there is shown an alternative arrangement to the secondary electrode shown in FIG. 2 and which is intended as a direct replacement for that electrode. The poppet valve 30 is identical to that previously described and has a valve head 32 and a valve stem 31. However, instead of the secondary electrode being a separate component it is formed as part of the cylinder head 11 surrounding a ceramic valve bushing 134. In the example shown there are four secondary electrodes 133 each of which has an inwardly directed projection 135 that extends over the valve seat 134 towards the valve head 32.

Figure 5:
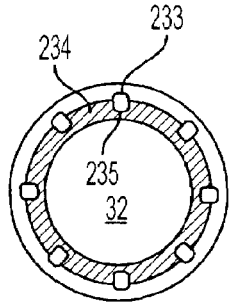
FIGS. 5 and 6 are views similar to FIG. 4*b* showing alternative secondary electrode arrangements.

With reference to FIG. 5, shown is an alternative arrangement to the secondary electrode shown in FIG. 2 and which is intended as a direct replacement for that electrode. The poppet valve 30 is identical to that previously described and has a valve head 32 and a valve stem (not shown). In this case, the secondary electrode comprises of eight separate electrodes 233 formed as part of the cylinder head 11 surrounding a ceramic valve bushing 234. Each of the secondary electrodes 233 has an inwardly directed projection 235 that extends over the valve seat 134 towards the valve head 32.

Figure 6:
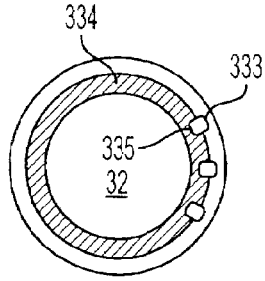

With reference to FIG. 6, shown is an alternative arrangement to the secondary electrode arrangement shown in FIG. 2 and which is intended as a direct replacement for that electrode arrangement. The poppet valve 30 is identical to that previously described and has a valve head 32 and a valve stem (not shown). In this case, the secondary electrode comprises of three separate electrodes 333 formed as part of the cylinder head 11 which overlap a ceramic valve bushing 334. Each of the secondary electrodes 333 has an inwardly directed projection 335 that extends over the valve seat 334 towards the valve head 32. The main difference between this embodiment and those shown in FIGS. 4*b* and 5 is that the secondary electrodes 333 are all located within one quadrant of the valve head 32 so as to produce initial combustion in a more closely defined location.

Figure 7A:
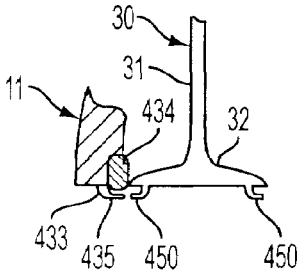
FIG. 7*a* is a scrap cross-section showing an alternative primary electrode arrangement to that shown in FIG. 4*a;*
Figure 7B:
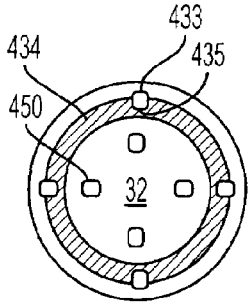
FIG. 7*b* is an end view of the poppet valve shown in FIG. 7*a;*

With reference to FIGS. 7*a* and 7*b*, there is shown an alternative arrangement to the primary electrode shown in FIG. 2 and which is intended as a direct replacement for that electrode. The secondary electrode is the same as that shown in FIGS. 4*a* and 4*b* having four electrodes 433 formed as part of the cylinder head 11 which surround a ceramic valve bushing 434. Each of the secondary electrodes 433 has an inwardly directed projection 435 that extends over the valve seat 434 towards the valve head 32. However, in this embodiment the primary electrode or to be more precise the valve head 32 has four outwardly extending projections 450 each of which is aligned with one of the secondary electrodes 433. That is to say, ideally the projections 450 are aligned with the projection 435 as shown in FIG. 7*b*. In practice, this alignment is unlikely to remain unless the valve 30 is provided with a means of holding it in one rotational position. However, as is the case in most engines, it is desirable to permit a poppet valve to rotate slowly relative to its valve seat in order to bed the valve head to the valve seat. There may therefore be a variation in the spark gap with this arrangement as the poppet valve rotates. As an alternative to the arrangement shown there may be a differing number of projections 450 on the valve head 32 to the number of secondary electrodes 433 located on the cylinder head 11.

Figure 8A:
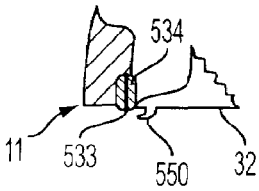
FIG. 8*a* is a scrap cross-section showing an alternative secondary electrode arrangement to that shown in FIG. 7*a;*
Figure 8B:
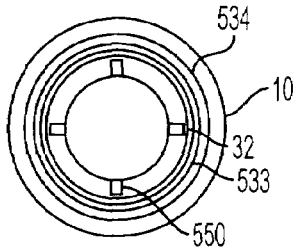
FIG. 8*b* is an end view of the poppet valve shown in FIG. 8*a;*

With reference to FIGS. 8*a* and 8*b*, there is shown an alternative arrangement of secondary electrode to that shown in FIGS. 7*a* and 7*b*. The poppet valve is identical to that previously described with respect to FIGS. 7*a* and 7*b* and has four outwardly extending projections 550 extending from the valve head 32.

However, in this embodiment the secondary electrode comprises of a single tungsten ring electrode 533 embedded in a ceramic valve bushing 534. One end of the ring electrode 533 is in contact with the cylinder head 11 and the other end projects out from the ceramic valve seat 534 so as to be positioned adjacent the four projections 550 on the valve head 32. Therefore, in this case, even if the poppet valve is permitted to rotate slowly relative to the valve seat 534, the spark gap will not alter.

As yet another alternative, the secondary electrode arrangement shown in FIGS. 8*a* and 8*b* can be combined with the poppet valve shown in FIG. 2 so that a spark can be produced at any position around the edge of the valve head 32 and the surrounding secondary electrode or, if sufficient energy is available, a continuous ring of discharge can be produced between the edge of the valve head 32 and the surrounding secondary electrode.

As yet another alternative, several independent electrodes could be embedded in the ceramic valve bushing 534 to replace the ring electrode.

Although the secondary electrodes as shown in FIGS. 4*a*, 5, 6 and 7*b* are all formed as part of the cylinder head 11, it will be appreciated that they could be separate components attached to the cylinder head 11. In this case, it would be desirable to manufacture each of the secondary electrodes from a tungsten material to reduce spark erosion.

Figure 9:
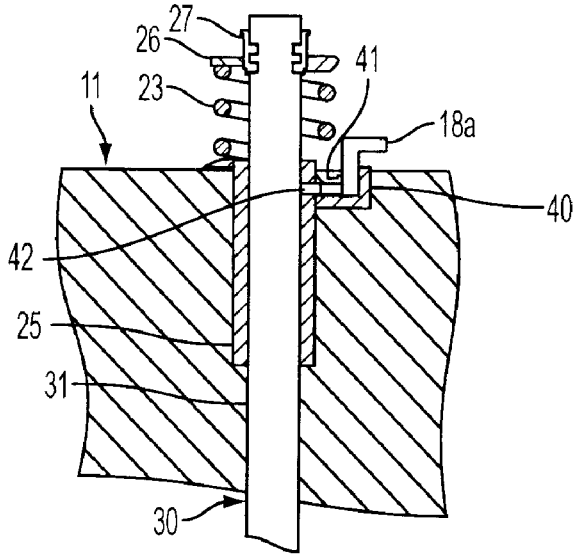
FIG. 9 is a partial cross-section showing an alternative form of electrical connection to that shown in FIG. 2.

With particular reference to FIG. 9, there is shown an alternative arrangement for providing voltage to the valve 30 which is intended to replace that shown in FIG. 2.

As before, the valve stem 31 is slidingly engaged with a sleeve 25 made from an electrical insulating material and the upper end of the valve stem 31 is adapted to allow the valve 30 to be reciprocally moved between open and closed positions by means of a valve actuation means (not shown). As before, the valve 30 is moved in this example by means of a cam operated rocker arm (not shown) which acts against a tappet (not shown) resting on the upper end of the valve stem 31. The tappet is electrically insulated from the valve stem by means of an insulating cap (not shown) made from a ceramic material.

As before, the valve spring 23 acts against a washer 26 held onto the valve stem 31 by means of a retainer 27, but in this case the lower end of the valve spring 23 abuts against an insulating washer. The tension connector 18*a* is embedded in an insulating block 40 fitted into a recess in the cylinder head 11. The insulating block has an internal bore in which is located a spring 41 used to bias a sliding contact member 42 against the valve stem 31. In use, a voltage pulse from the tension generator 16 passes along the tension lead 17*a* to the tension connector 18*a* when combustion is required in the respective combustion chamber in which the valve 30 is located.

The voltage flows through the spring 41 to the sliding contact member 42, into the valve stem 31 and along the valve stem 31 to the valve head (not shown) and then discharges across a small gap to one or more secondary electrodes connected to or formed as part of the cylinder head 11.

Figure 10:
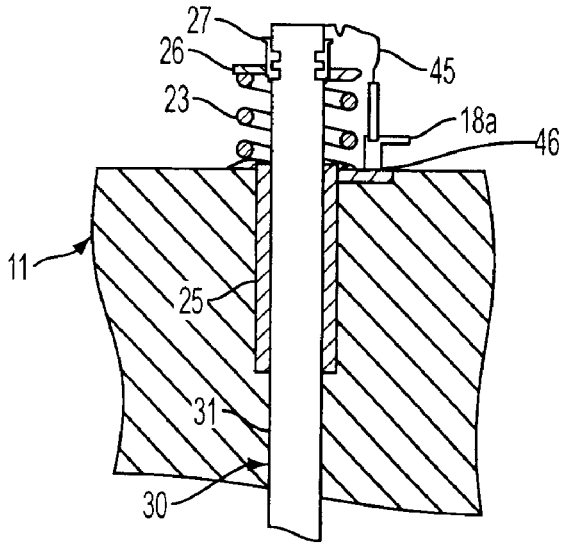
FIG. 10 is a partial cross-section showing an alternative form of electrical connection to that shown in FIG. 2.

With particular reference to FIG. 10, there is shown a further alternative arrangement for providing voltage to the valve 30 which is intended to replace that shown in FIG. 2.

As before, the valve stem 31 is slidingly engaged with a sleeve 25 made from an electrical insulating material and the upper end of the valve stem 31 is adapted to allow the valve 30 to be reciprocally moved between open and closed positions by means of a valve actuation means (not shown). As before, the valve 30 is moved by means of a cam operated rocker arm (not shown) which acts against a tappet (not shown) resting on the upper end of the valve stem 31. The tappet is electrically insulated from the valve stem by means of an insulating cap (not shown) made from a ceramic material.

The valve spring 23 acts as before against a washer 26 held onto the valve stem 31 by means of a retainer 27 but in this case the lower end of the valve spring 23 abuts against an insulating washer. The tension connector 18*a* is embedded in an insulating block 46 fitted into a recess in the cylinder head 11. A fly lead 45 made from a flexible conductive material covered in an insulating material is connected between the tension connector 18*a* and the upper end of the valve stem 31.

In use, a voltage pulse from the tension generator 16 passes along the tension lead 17*a* to the tension connector 18*a* when combustion is required in the respective combustion chamber with which the valve 30 cooperates. The voltage flows through the fly lead 45 into the valve stem 31 and along the valve stem 31 to the valve head (not shown) and then discharges across a small gap to one or more secondary electrodes connected to or formed as part of the cylinder head 11.

Figure 11:
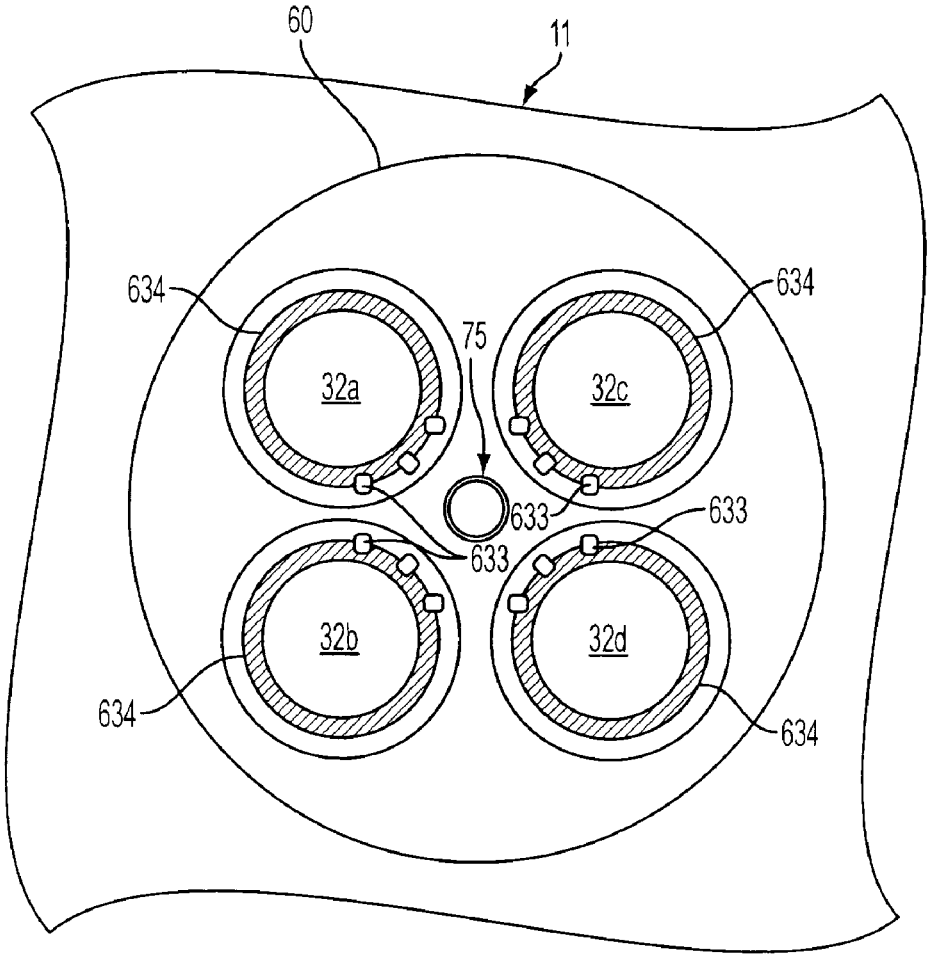
FIG. 11 is a plan view of the cylinder head shown in FIG. 2.

With reference to FIG. 11, there is shown the cylinder head 11 in the region of one combustion chamber. The cylinder head 11 has a recess 60 formed therein of approximately the same diameter as the cylinder with which it co-operates. A fuel injector nozzle 75 is centrally located in the recess 60 so as to be positioned on a center line of the cylinder with which the cylinder head 11 cooperates. This means that the injector nozzle 75 is equidistantly positioned with respect to the wall of the cylinder.

The combustion chamber has four poppet valves associated with it, each of the poppet valves has a head 32*a*, 32*b*, 32*c*, 32*d* which forms a primary electrode. Two of the poppet valves are inlet valves and their heads 32*a*, 32*b* are moved away from a cooperating valve seat 634 to admit air into the combustion chamber during an inlet stroke of the engine 10 and two of the poppet valves are exhaust valves and their heads 32*c*, 32*d* are moved away from a cooperating valve seat 634 to allow the by-products of combustion to escape from the combustion chamber during an exhaust stoke of the engine 10.

In the example shown, the valve heads 32*a*, 32*b*, 32*c*, 32*d*, the secondary electrodes 633 and the valve seat 634 are of the same form as those shown and described with respect to FIG. 6, but it will be appreciated that other forms of poppet valve, primary electrode, secondary electrode or valve seat could be used. Note that not only are ignition initiators located at spaced apart positions of the combustion chamber (the four corners), at each of these locations more than one discharge pair is formed.

Because all of the poppet valves have a primary electrode forming part of at least one electrode pair, various combustion strategies can be followed.

Firstly, all of the primary electrodes formed by the valve heads 32*a*, 32*b*, 32*c*, 32*d* can be supplied with a voltage pulse at the same time so as to produce electrical discharges simultaneously between all of the primary electrodes formed by the valve heads 32*a*, 32*b*, 32*c*, 32*c* and the secondary electrodes 633. That is to say, the ignition timing for all of the electrode pairs is the same.

This has the advantage that the time taken for the flame fronts produced by combustion in the combustion chamber to propagate throughout the combustion chamber is reduced compared to a single point spark arrangement. A further advantage is that, because electrical discharges are occurring at a number of points in the combustion chamber, there is no need to accurately control the flow of the mixture in the combustion chamber so as to position it precisely by a source of discharge at a particular point in time. This means that the shape or configuration of the combustion chamber and inlet port can be less complex and so less time and expenditure is required to design the combustion chamber.

Also, because the flame front, or to be more precise the four flame fronts, take less time to reach the remote parts of the combustion chamber, as there is less distance for each flame front to travel, the amount of ignition advance relative to top dead center can be reduced. This is important because the amount of ignition advance is a limiting factor regarding the maximum running speed of an engine. If the time taken for the flame fronts to reach the remote parts of the combustion chamber is reduced, the maximum operating speed of the engine can be safely increased without increasing the probability of knock occurring.

A second strategy that can be followed is to independently control the ignition timing of each primary electrode using the electronic control unit 15. This allows combustion initiation to occur at any of the poppet valves at any particular point in time so as to increase combustion efficiency.

So, for example, the primary electrodes could be energized sequentially starting with any one of the poppet valves and continuing with the other poppet valves in a predetermined order.

Alternatively, the ignition timing of each primary electrode can be independently controlled based upon the operating conditions of the engine so as to improve combustion in the respective combustion chamber.

That is to say, the independent control of the ignition timing of the primary electrodes allows the point of ignition to be moved around in the combustion chamber to match a predicted position of the mixture within the combustion chamber for any load state based upon experimental flow work. The location of the optimum mixture in the combustion chamber is in this case stored in a look-up table or is calculated based upon an algorithm derived from the experimental flow work and then an appropriate ignition timing for each of the primary electrodes is selected based upon the current engine speed and load.

This has the advantage that the point of ignition can be matched to a predicted location of the mixture to be ignited rather than relying on a complex combustion chamber shape to manipulate the flow of the mixture in the combustion chamber. This at least partially eliminates the need for a complex inlet and combustion chamber design to be used.

Therefore, accelerating the burn rate by creating flame fronts at more than one location and by reducing the distance for these flame fronts to propagate permit a reduced spark advance to be used for the same speed/load condition thus leading to a decreased likelihood of knock and reduced heat losses through the cylinder walls. Conversely, for a given spark advance a given engine may be run at a higher speed.

Care must be taken if the interaction of the separate flame fronts causes engine knock. To compensate for this effect different spark locations and combinations or locations at the same or different times can be used to increase the beneficial effects of multipoint ignition. Creating ignition at each valve sequentially so as to separate in time and space the ignition events can be used to alter the point of ignition to compensate for charge motion.

Because the motion of the fuel/air charge within the cylinder may be different for different speed/load conditions, it is possible to ignite the mixture at any valve location within the combustion chamber so as to match the point of ignition with the mixture location. This allows the mixture to be ignited at the appropriate valve given the predicted location of the charge for the current speed/load condition and allows the ignition point to be moved as the speed/load changes.

The use of an ignition system according to this description on an engine would therefore lead to a simplification of the air intake system as the ignition point may be adjusted to follow the charge rather than being forced to design the air intake system such that the charge is guaranteed to be located with a fixed ignition point.

The deliberate use of late ignition through use of one or more exhaust valves having primary electrodes can be used as a means of enhancing catalyst heating in order to reduce emissions at engine start. Following normal combustion in a direct injection engine an additional late injection event is used during the exhaust stroke with the primary electrodes formed as part of the exhaust valves being energized as the mixture flows out of the combustion chamber so as to ignite the mixture flowing out of the engine. This post engine combustion then facilitates catalyst heating. This would enable the spark advance to be optimal during engine start up to warm the engine as rapidly as possible and so reduce friction/heat losses.

Although the use of one or more valves as primary electrodes as described above works well in all direct injection engines, it is desirable, if used in a port injected engine, to either increase the depth of the valve seat around the valve head within the intake port to remove the possibility of arcing occurring within the intake port which could cause combustion in the intake port or use only the exhaust valves as primary electrodes which would totally eliminate any risk of ignition occurring within the intake port.

Although the description has so far been described solely with reference to an embodiment utilizing a substantially standard poppet valve electrically isolated from the cylinder head, it will be appreciated that other forms of poppet valve could be used.

Figure 12:
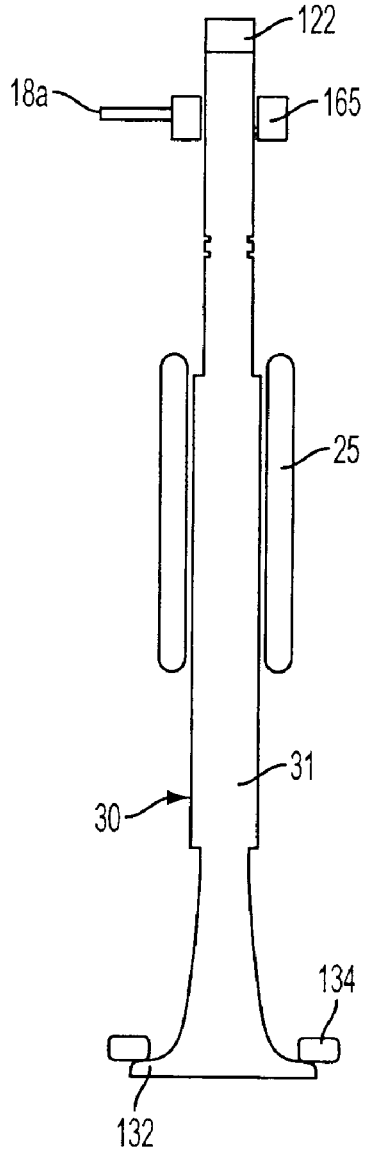
FIG. 12 is a side view of a first alternative poppet valve to that shown in FIG. 2.

In FIG. 12 an alternative design of poppet valve is shown which is in most respects the same as that previously described with reference to FIG. 2. The poppet valve 30 comprises a valve stem 31 to slideably support the poppet valve 30 in a cylinder head of an engine and a valve head 132 to selectively close off an inlet or exhaust port.

The valve stem 31 is slidingly engaged with a sleeve 25 made from an electrical insulating material such as a ceramic material. A ceramic valve seat 134 is used to electrically insulate the valve head 132 from the cylinder head. Voltage is selectively supplied to the poppet valve 30 via a collet 165 slidingly engaged with the valve stem 31. The tension connector 18*a* is connected to the collet 165 to supply voltage from a tension lead (not shown) to the collet 165. To prevent the voltage passing into the mechanism used to actuate the poppet valve 30, an insulating valve spring cap 122 is attached to the upper end of the valve stem 31. Operation is as previously described with reference to FIG. 2.

Figure 13A:
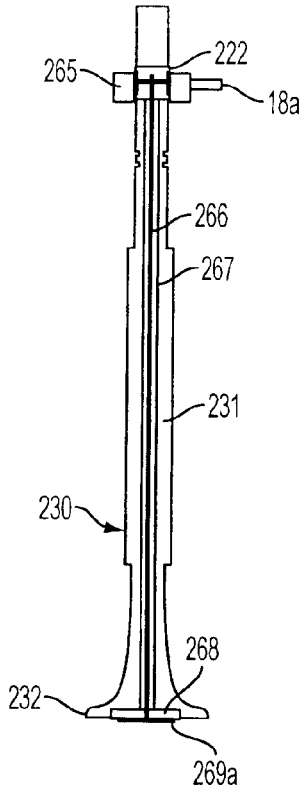
FIG. 13*a* is a side view of a second alternative poppet valve to that shown in FIG. 2.
Figure 13B:
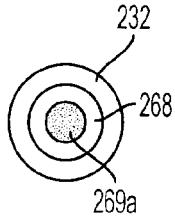
FIG. 13*b* is an end view of the poppet valve shown in FIG. 13*a;*

In FIGS. 13*a* and 13*b*, an alternative design of poppet valve is shown which is intended as a direct replacement for the poppet valve shown in FIG. 2. The poppet valve 230 comprises a valve stem 231 to slideably support the poppet valve 230 in a cylinder head of an engine and a valve head 232 to selectively close off an inlet or exhaust port.

The poppet valve 230 is a hollow electrically conductive component defining an internal cavity used to house an internal member 267 made from an insulating material such as a ceramic. The internal member 267 has an electrically conductive core 266 forming the primary electrode.

Voltage is selectively supplied to the poppet valve 230 via a collet 265 slidingly engaged with an annular contact located towards an upper end of the valve stem 231. The tension connector 18*a* is connected to the collet 265 to supply voltage from a tension lead (not shown) to the collet 265. The collet 265 cooperates with the annular contact which is electrically connected to the electrically conductive core 266 but is electrically insulated from the valve stem 231 by means of a ceramic insert 222.

The lower end of the electrically conductive core has a head 269*a* separated from the valve head 232 by an insulating washer 268 which can be formed as an integral part of the internal member 267 if required. Alternatively, the face of the valve head 232 could be coated with an insulating material so that the insulating washer or spacer is formed as an integral part of the poppet valve 230.

In use, a voltage pulse received via the collet 265 is transferred to the head 269*a* which is located close to one or more secondary electrodes formed as part of or attached to the cylinder head. One or more electrode pairs are thereby produced which are used to initiate combustion in the combustion chamber in which the valve head 232 is located.

One of the advantages of this embodiment is that the valve head 232 and valve stem 231 can be made of a conventional poppet valve material and the electrically conductive core 266 can be made of a spark erosion resistant material such as tungsten.

Figure 14:
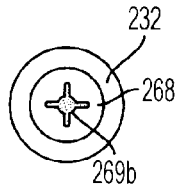
FIG. 14 is an end view of an alternative primary electrode arrangement to that shown in FIG. 13*b;*

FIG. 14 shows an alternative form of head 269*b* to that shown in FIG. 13*b*. The head 269*b* has four radially extending projections to ensure that several electrode pairs are produced.

Figure 15A:
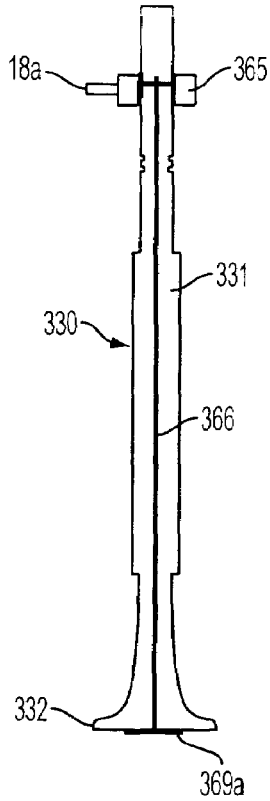
FIG. 15*a* is a side view of a third alternative poppet valve to that shown in FIG. 2.
Figure 15B:
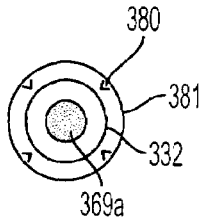
FIG. 15*b* is an end view of the poppet valve shown in FIG. 15*a*.

In FIGS. 15*a* and 15*b*, an alternative design of poppet valve 330 is shown which is intended as a direct replacement for the poppet valve shown in FIG. 2. The poppet valve 330 comprises a valve stem 331 to slideably support the poppet valve 330 in a cylinder head of an engine and a valve head 332 to selectively close off an inlet or exhaust port.

The poppet valve 230 is made from an electrically insulating material such as ceramic and has an internal cavity used to house an electrically conductive core 366 forming the primary electrode.

Voltage is selectively supplied to the poppet valve 330 via a collet 365 slidingly engaged with an annular contact located towards an upper end of the valve stem 331. The tension connector 18*a* is connected to the collet 265 to supply voltage from a tension lead (not shown) to the collet 265. The collet 265 cooperates with the annular contact which is electrically connected to the electrically conductive core 266.

The lower end of the electrically conductive core has a head 369*a*.

In use, a voltage pulse received via the collet 365 is transferred to the head 369*a* which is located close to one or more secondary electrodes 380 formed in a valve pocket 381 of the cylinder head. One or more electrode pairs are thereby produced which are used to initiate combustion in the combustion chamber in which the valve head 332 is located.

One of the advantages of this embodiment is that the electrically conductive core 366 can be made of a spark erosion resistant material such as tungsten.

Figure 16:
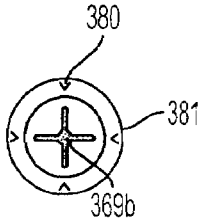
FIG. 16 is an end view of an alternative primary electrode arrangement to that shown in FIG. 15*b*

FIG. 16 shows an alternative form of head 369*b* to that shown in FIG. 15*b*. The head 369*b* has four radially extending projections to ensure that several electrode pairs are produced in combination with the secondary electrodes 380.

Therefore, in summary, the description provides an improved apparatus for initiating combustion in a cylinder of an internal engine by utilizing one or more of the poppet valves used to control the flow of gas into and out of the cylinder as one electrode of an electrode pair.

Although a number of poppet valve arrangements have been shown, it will be appreciated that the description is not limited to these embodiments and any poppet valve arrangement that permits one or more electrical discharges to be transmitted to a second component located close to the poppet valve but not formed as part of the poppet valve could be used in any engine manufactured according to this description.

It will also be appreciated that other arrangements of secondary electrode could be used without departing from the scope of this description. For example, the secondary electrode could be formed by a fuel injector nozzle or could be a pimple formed on the piston or the cylinder head could be made from an electrically insulating material and have secondary electrodes embedded in it.

It will be further appreciated that the description is not limited to use with a three cylinder engine of an inline configuration but could be applied to other engine configurations having more or less cylinders.

It will also be appreciated that the description could be applied to spark assist engines in which an electrical discharge is used to start the engine or any other types of internal combustion engine having poppet valves requiring spark ignition during specific operating conditions.

It will therefore be appreciated by those skilled in the art that although the description has been described by way of example with reference to one or more embodiments it is not limited to the disclosed embodiments and that one or more modifications to the disclosed embodiments or alternative embodiments could be constructed without departing from the scope of the description.

The invention claimed is:

1. A system for combusting an air-fuel mixture, the system comprising:

an internal combustion engine having at least a combustion chamber comprised of a cylinder head, piston, and cylinder block; said at least a combustion chamber having a plurality of poppet valves to selectively allow gas to flow into and out of the respective combustion chamber, said plurality of poppet valves including at least a first valve having a portion forming at least a primary electrode that cooperates in use with at least a secondary electrode thereby forming a number of electrode pairs that are capable of producing a spark in said combustion chamber, said at least a secondary electrode formed at a location other than at one of said plurality of poppet valves; and a controller to supply voltage independently to each of said number of electrode pairs.

2. The system of claim 1 wherein said controller supplies voltage to at least said poppet valve independent of voltage applied to other poppet valves of said plurality of poppet valves.

3. The system of claim 1 wherein there are a plurality of secondary electrodes each forming in combination with at least said primary electrode a respective one of the number of electrode pairs.

4. The system of claim 1 wherein said at least a primary electrode has a number of discharge tips each forming in combination with the at least one secondary electrode a number of electrode pairs.

5. The system of claim 1 wherein a plurality of primary electrodes is formed on at least one of said plurality of poppet valves.

6. The system of claims 1 wherein each combustion chamber has two or more poppet valves each having a primary electrode forming in combination with at least one secondary electrode a number of electrode pairs.

7. The system of claim 5 wherein all of the poppet valves of each cylinder have an electrode forming part of at least one electrode pair.

8. The system of claim 6 wherein the ignition timing of each primary electrode is independently controlled.

9. The system of claim 1 wherein voltage is applied to more than one poppet valve operating in said combustion chamber simultaneously.

10. The system of claim 1 wherein said controller sets the ignition timing of each primary electrode based on operating conditions of the engine.

11. The system of claim 1 wherein said secondary electrode is integrated into said cylinder head.

12. The system of claim 1 wherein said internal combustion engine is a multi-cylinder engine.

13. A system for combusting an air-fuel mixture, the system comprising:

an internal combustion engine having at least a combustion chamber comprised of a cylinder head, piston, and cylinder block;

said at least a combustion chamber having a plurality of poppet valves to selectively allow gas to flow into and out of the respective combustion chamber, said plurality of poppet valves including at least a first poppet valve having a portion forming at least a primary electrode that cooperates in use with at least a secondary electrode thereby forming a number of electrode pairs that are capable of producing a spark in said combustion chamber, said at least a secondary electrode formed at a location other than at one of said plurality of poppet valves; and a controller to sequentially supply voltage independently to each of said number of electrode pairs.

14. The system of claim 13 wherein said controller moves the point of ignition in said combustion chamber as engine load varies.

15. The system of claim 13 wherein fuel is injected directly into said combustion chamber.

16. The system of claim 13 wherein said first poppet valve is an exhaust valve.

17. The system of claim 13 wherein said first poppet valve is an intake valve.

18. The system of claim 13 wherein said poppet valve is made partially of an insulating material.

19. The system of claim 13 wherein said secondary electrode is integrated into said cylinder head.

* * * * *